US008378899B2

(12) United States Patent
Galeev

(10) Patent No.: US 8,378,899 B2
(45) Date of Patent: Feb. 19, 2013

(54) WIRELESS COMMUNICATION TERMINAL WITH A MULTI-BAND ANTENNA THAT EXTENDS BETWEEN SIDE SURFACES THEREOF

(75) Inventor: Roustem Galeev, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 623 days.

(21) Appl. No.: 12/613,843

(22) Filed: Nov. 6, 2009

(65) Prior Publication Data

US 2011/0109514 A1 May 12, 2011

(51) Int. Cl.
*H01Q 1/24* (2006.01)
*H01Q 1/42* (2006.01)

(52) U.S. Cl. ..... 343/702; 343/872

(58) Field of Classification Search ..... 343/702, 343/872, 873

See application file for complete search history.

(56) References Cited

U.S. PATENT DOCUMENTS

| | | | | |
|---|---|---|---|---|
| 6,903,686 | B2 | 6/2005 | Vance et al. | |
| 6,909,402 | B2 | 6/2005 | Vance | |
| 6,943,733 | B2 | 9/2005 | Vance | |
| 7,109,924 | B2 | 9/2006 | Vance | |
| 2004/0075613 | A1 * | 4/2004 | Jarmuszewski et al. | 343/702 |
| 2011/0057843 | A1 * | 3/2011 | Hallivuori | 343/700 MS |

FOREIGN PATENT DOCUMENTS

| | | | |
|---|---|---|---|
| EP | 1 684 379 | A1 | 7/2006 |
| EP | 1 950 833 | A1 | 7/2008 |
| KR | 10-2007-0097835 | | 10/2007 |
| WO | WO 2005/043674 | A1 | 5/2005 |

OTHER PUBLICATIONS

Notification of Transmittal of the International Search Report and the Written Opinion of the International Searching Authority, or the Declaration; International Search Report; Written Opinion of the International Searching Authority corresponding to International Application No. PCT/IB2010/002583; Date of Mailing: Dec. 30, 2010; 12 pages.

* cited by examiner

*Primary Examiner* — Robert Karacsony
(74) *Attorney, Agent, or Firm* — Myers Bigel Sibley & Sajovec, P.A.

(57) ABSTRACT

A wireless communications terminal can include a housing having an interior surface that is configured to enclose at least a controller circuit, a transceiver circuit, and a RF feed circuit and to at least partially enclose a display device and a user input interface. The housing extends between opposing top and bottom surfaces, between opposing first and second side surfaces, and between opposing front and back surfaces. A first radiator line is connected on distal ends to a feed node and to a ground node and extends in a loop across at least a majority of a width of the housing between the first and second side surfaces. The first radiator line resonates in a first frequency range responsive to first electromagnetic radiation coupled to the feed and ground nodes. A second radiator line is connected to the feed node and extends away from an adjacent portion of the first radiator line, and resonates in a second frequency range responsive to second electromagnetic radiation coupled to the feed and ground nodes. A third radiator line is connected to the first radiator line at a branch node that is spaced apart from the feed node and the ground node, and extends away from an adjacent portion of the first radiator line and resonates in a third frequency range responsive to third electromagnetic radiation coupled to the feed and ground nodes.

16 Claims, 4 Drawing Sheets

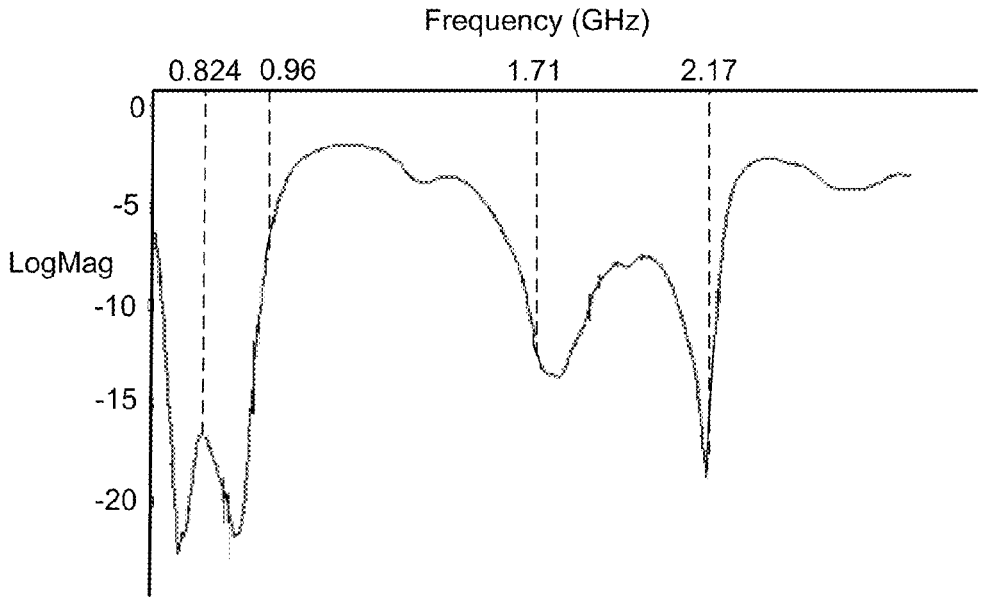
FIGURE 6
FIGURE 7
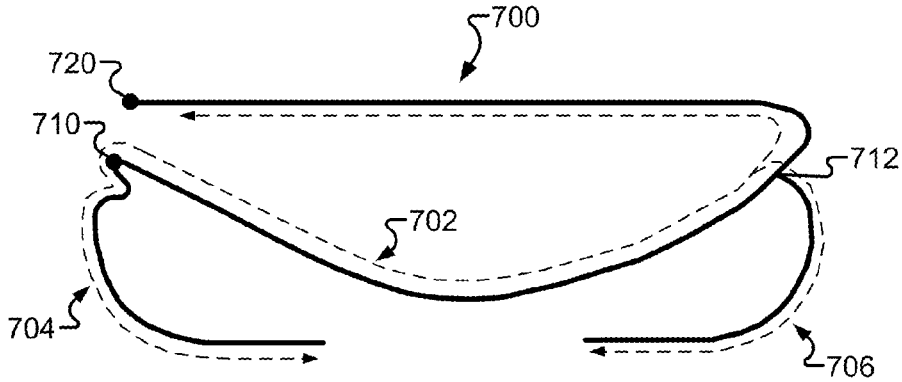
FIGURE 8
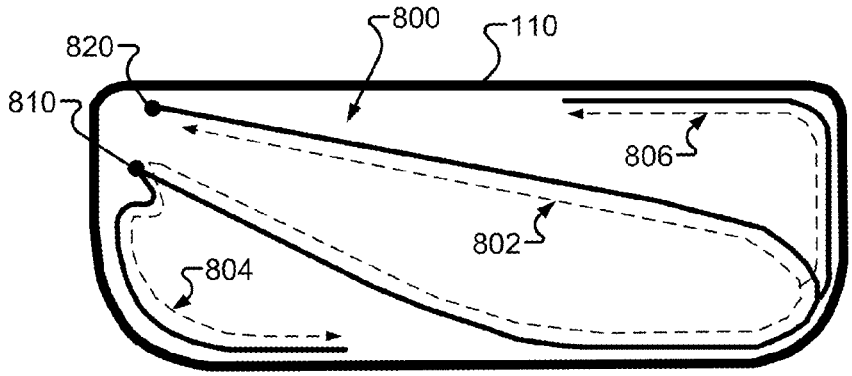

WIRELESS COMMUNICATION TERMINAL WITH A MULTI-BAND ANTENNA THAT EXTENDS BETWEEN SIDE SURFACES THEREOF

FIELD OF THE INVENTION

The invention generally relates to the field of communications, and more particularly, to antennas that are used by wireless communication terminals for transmission and reception.

BACKGROUND OF THE INVENTION

Wireless terminals may operate in multiple frequency bands in order to provide operations in multiple communications systems. For example, many cellular radiotelephones are now designed for pentaband operation in GSM and WCDMA modes at nominal frequencies of 850 MHz, 900 MHz, 1800 MHz, 1900 MHz, and 2100 MHz.

Achieving effective performance in all of the above described frequency bands (i.e., "multi-band") may be difficult. Contemporary wireless terminals are increasingly packing more circuitry and larger displays and keypads/keyboards within small housings. As a consequence, there has been increased use of semi-planar antennas, such as a multi-branch inverted-F antenna, that may occupy a smaller space within a terminal housing. The semi-planar antenna can be printed on/mounted to the terminal's main printed circuit board, but should be placed away from a ground plane of the terminal's printed circuit board to be useful. Constraints on the available space and location for the branches of the antenna can negatively affect the antenna performance.

SUMMARY

Embodiments according to the invention can provide multi-band antennas for use in wireless communication terminals. In some embodiments, a wireless communications terminal includes a housing having an interior surface that is configured to enclose at least a controller circuit, a transceiver circuit, and a RF feed circuit and is configured to at least partially enclose a display device and a user input interface. The housing extends between opposing top and bottom surfaces, between opposing first and second side surfaces, and between opposing front and back surfaces. A first radiator line is connected on distal ends to a feed node and to a ground node and extends in a loop across at least a majority of a width of the housing between the first and second side surfaces. The first radiator line is configured to resonate in a first frequency range responsive to first electromagnetic radiation coupled to the feed and ground nodes. A second radiator line is connected to the feed node and extends away from an adjacent portion of the first radiator line, and is configured to resonate in a second frequency range responsive to second electromagnetic radiation coupled to the feed and ground nodes. A third radiator line is connected to the first radiator line at a branch node that is spaced apart from the feed node and the ground node, and extends away from an adjacent portion of the first radiator line and is configured to resonate in a third frequency range responsive to third electromagnetic radiation coupled to the feed and ground nodes. The first, second, and third frequency ranges are different from one another.

The first radiator line may extend from the feed node, which is adjacent to the first side surface, through a central region of the housing and the branch node, which is adjacent to the second side surface, and loop back to the ground node, which is adjacent to the first side surface.

The first, second, and third radiator lines may extend along a flexible film surface, and they may be integrally formed as a single layer on the flexible film surface.

The first, second, and third radiator lines may extend along a single flexible film surface. The first radiator line may extend on the flexible film surface across the terminal and be fixedly attached to the top surface or the bottom surface. The second and third radiator lines may extend on the flexible film surface along and be fixedly attached to at least one side surface of the housing. The second and third radiator lines may extend on the flexible film surface along and be fixedly attached to opposite side surfaces of the housing.

The terminal may further include a printed circuit board that electrically connects and fixedly supports the controller circuit, the transceiver circuit, and the RF feed circuit, the printed circuit board having opposing major surfaces. The first, second, and third radiator lines may be arranged to not overlap either of the opposing major surfaces of the printed circuit board.

The first, second, and third radiator lines may be located in a bottom portion of the housing relative to how the housing is held by a user during voice communications through the enclosed controller, transceiver, and RF feed circuits, and the first, second, and third radiator lines may be spaced apart from an edge of the printed circuit board.

The first, second, and third radiator lines may be located in a top portion of the housing relative to how the housing is held by a user during voice communications through the enclosed controller, transceiver, and RF feed circuits, and the first, second, and third radiator lines may be spaced apart from an edge of the printed circuit board.

The third radiator line may be connected to the branch node midway along a length of the first radiator line between the feed node and the ground node.

The first radiator line may extend to the ground node adjacent to one of the front and back housing surfaces, the second radiator line may extend along the first side housing surface and along the other one of the front and back housing surfaces that is opposite the ground node, and the third radiator line may extend along the second side housing surface and along the same one of the front and back housing surfaces as the second radiator line. A portion of the first radiator line may be fixedly connected to and supported by the one of the front and back interior housing surfaces that is adjacent to the ground node. A majority of the second radiator line may be fixedly connected to and supported by both the first side interior housing surface and the other one of the front and back interior housing surfaces that is opposite to that adjacent the ground node. The third radiator line may be fixedly connected to and supported by both the second side interior housing surface and the same one of the front and back interior housing surfaces as the second radiator line. The second and third radiator lines may extend in opposite directions toward each other along at least a quarter of the one of the front and back interior housing surfaces that is opposite to that adjacent the ground node.

The first radiator line may extend to the ground node adjacent to one of the front and back housing surfaces, the second radiator line may extend along the first side housing surface and along the other one of the front and back housing surfaces that is opposite to that adjacent the ground node, and the third radiator line may extend along the second side housing surface and along the same one of the front and back surfaces as the ground node. A portion of the first radiator line may be fixedly connected to and supported by the one of the front and back interior housing surfaces that is adjacent to the ground node. A majority of the second radiator line may be fixedly connected to and supported by both the first side interior housing surface and the other one of the front and back interior housing surfaces that is opposite to that adjacent the ground node. The third radiator line may be fixedly connected to and supported by both the second side interior housing surface and the same one of the front and back interior housing surfaces that is adjacent to the ground node. The second and third radiator lines may each extend in opposite directions toward each other along at least a quarter of respective ones of the front and back interior housing surfaces.

The first frequency range resonated by the first radiator line may be a higher frequency range than the second and third frequency ranges. The second frequency range resonated by the second radiator line may be a higher frequency range than the third frequency range. A length of the first radiator line between the feed node and the ground node may be at least twice as long as a length of the second radiator line and a length of the third radiator line. The first frequency range resonated by the first radiator line may be in a frequency range between 2000 and 2700 MHz, the second frequency range resonated by the second radiator line may be in a frequency range between 1700 and 2000 MHz, and the third frequency range resonated by the third radiator line may be in a frequency range between 1800 and 2000 MHz. The first frequency range resonated by the first radiator line may include 2100 MHz, the second frequency range resonated by the second radiator line may include 1800 MHz, and the third frequency range resonated by the third radiator line may include 850 MHz.

In some other embodiments, a wireless communications terminal includes a housing, an antenna that includes first, second, and third radiator lines, and a printed circuit hoard. The housing has an interior surface that is configured to enclose at least a controller circuit, a transceiver circuit, and a RF feed circuit and is configured to at least partially enclose a display device and a user input interface. The housing extends between opposing top and bottom surfaces, between opposing first and second side surfaces, and between opposing front and back surfaces.

The first radiator line extends from a feed node that is adjacent to the first side surface through a central region of the housing and a branch location adjacent to the second side surface and loops back to a ground node that is adjacent to the first side surface. The first radiator line is configured to resonate in a first frequency range responsive to first electromagnetic radiation coupled to the feed and ground nodes. A portion of the first radiator line is fixedly connected to and supported by the one of the front and back interior housing surfaces that is adjacent to the ground node.

The second radiator line is integrally connected to the first radiator line at the feed node and extends away from the ground node toward the front/back surface of the housing, and is configured to resonate in a second frequency range responsive to second electromagnetic radiation coupled to the feed and ground nodes. A majority of the second radiator line is fixedly connected to and supported by both the first side interior housing surface and the other one of the front and back interior housing surfaces that is opposite the ground node.

The third radiator line is integrally connected to the branch node and extends away from an adjacent portion of the first radiator line, and is configured to resonate in a third frequency range responsive to third electromagnetic radiation coupled to the feed and ground nodes. The first, second, and third frequency ranges are different from one another. The third radiator line is fixedly connected to and supported by both the second side interior housing surface and the same one of the front and back interior housing surfaces as the second radiator line.

The printed circuit board has opposing major surfaces and electrically connects and fixedly supports the controller, transceiver, and RF feed circuits. The first, second, and third radiator lines are located in a bottom portion of the housing relative to how the housing is held by a user during voice communications through the enclosed controller, transceiver, and RF feed circuits, and the first, second, and third radiator lines are spaced apart from an edge of the printed circuit board.

Other antennas, wireless terminals, methods, and/or systems according to embodiments of the invention will be or become apparent to one with skill in the art upon review of the following drawings and detailed description. It is intended that all such additional antennas, terminals, methods, and/or systems be included within this description, be within the scope of the present invention, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings:

FIG. 6 is a graph that illustrates exemplary LogMag that may be provided by the tri-band antenna of FIGS. 2-3 according to some embodiments of the invention;

FIG. 7 illustrates a modified embodiment of the tri-band antenna that is shown in FIGS. 2-3 according to some embodiments of the present invention; and FIG. 8 illustrates another cross-sectional view of the wireless communications terminal of FIG. 1 that shows another exemplary tri-band antenna that extends along portions of the inner peripheral surfaces of the terminal's housing according to some embodiments of the present invention.

DETAILED DESCRIPTION OF EMBODIMENTS ACCORDING TO THE INVENTION

Figure 1:
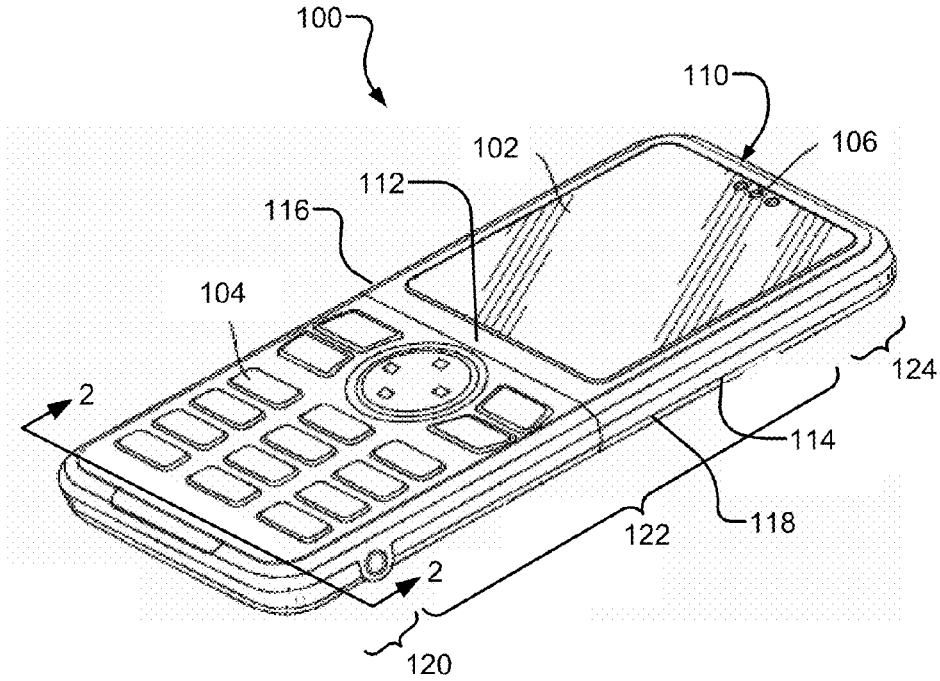
FIG. 1 illustrates a multi-band wireless communications terminal according to some embodiments of the present invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "coupled" to another element, it can be directly coupled to the other element or intervening elements may be present. In contrast, when an element is referred to as being "directly coupled" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

For purposes of illustration and explanation only, various embodiments of the present invention are described herein in the context of tri-band wireless communication terminals ("wireless terminals"/"terminals") that are configured to carry out cellular communications (e.g., cellular voice and/or data communications) in more than one frequency band. It will be understood, however, that the present invention is not limited to such embodiments and may be embodied generally in any wireless communication terminal that includes a multi-band RF antenna that is configured to transmit and receive in two or more frequency bands.

As used herein, the term "multi-band" can include, for example, operations in any of the following bands: Advanced Mobile Phone Service (AMPS), ANSI-136, Global Standard for Mobile (GSM) communication, General Packet Radio Service (GPRS), enhanced data rates for GSM evolution (EDGE), DCS, PDC, PCS, code division multiple access (CDMA), wideband-CDMA, CDMA2000, and/or Universal Mobile Telecommunications System (UMTS) frequency bands. GSM operation can include transmission in a frequency range of about 824 MHz to about 849 MHz and reception in a frequency range of about 869 MHz to about 894 MHz. EGSM operation can include transmission in a frequency range of about 880 MHz to about 914 MHz and reception in a frequency range of about 925 MHz to about 960 MHz. DCS operation can include transmission in a frequency range of about 1710 MHz to about 1785 MHz and reception in a frequency range of about 1805 MHz to about 1880 MHz. PDC operation can include transmission in a frequency range of about 893 MHz to about 953 MHz and reception in a frequency range of about 810 MHz to about 885 MHz. PCS operation can include transmission in a frequency range of about 1850 MHz to about 1910 MHz and reception in a frequency range of about 1930 MHz to about 1990 MHz. Other bands can also be used in embodiments according to the invention.

FIG. 1 illustrates a multi-band wireless communications terminal 100 according to some embodiments of the present invention. The terminal 100 includes a housing 110, which for purposes of exemplary description herein is shown as including a front surface 112 and a back surface 114 that extend between side surfaces 116 and 118 to define a cavity therein. A display device 102 and a user input interface 104 (e.g. keypad and/or keyboard) are at least partially disposed in the front surface 112. A multiband communications antenna along with various electronic communications circuitry described further below are enclosed within the housing 110 and configured to transmit and receive wireless communication signals with another communication device (e.g. terminal, base station, etc.) through a plurality of frequency bands.

In accordance with some embodiments, the multiband antenna resides in a bottom portion 120 of the housing 110 relative to how the housing 110 is held by a user during voice communications through the associated communications circuitry. It will be understood however that the terminal 100 may be placed in other orientations while in use such as in speaker phone mode or when a separate headset is in use. Configuring the multiband antenna to be in the bottom portion 120 away from a central portion 122 of the housing 110, where the user's hand would typical be located during a voice call, may improve the operational characteristics of multiband antenna by avoiding interference that may otherwise be caused by the user's hand. The multiband antenna may alternatively be configured to reside in a top portion 124 of the housing 110. However, the performance of the multiband antenna may be degraded by an adjacent loudspeaker 106 residing in the housing 110 and/or by the user's head which would be proximately located to the loudspeaker 106 during voice communications.

Figure 2:
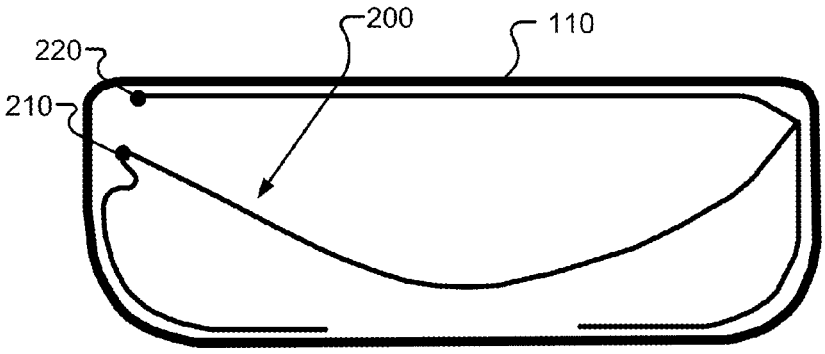
FIG. 2 illustrates a cross-sectional view of the wireless communications terminal of FIG. 1 that shows a tri-band antenna that extends along portions of the inner peripheral surfaces of the terminal's housing according to some embodiments of the present invention.
Figure 3:
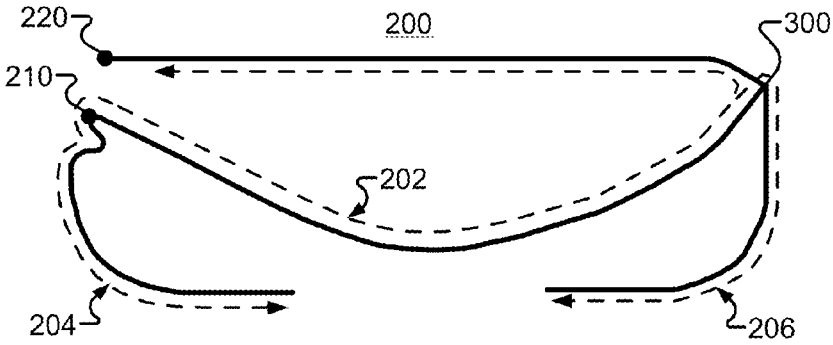
FIG. 3 further illustrates the tri-band antenna of FIG. 1 and the first, second, and radiator lines thereof that respectively resonant in three different frequency ranges according to some embodiments of the present invention.

FIG. 2 illustrates a cross-sectional view along plane 2-2 through the terminal 100 of FIG. 1 that shows a tri-band antenna 200 that extends along portions of the inner peripheral surfaces of the terminal's housing 110 according to some embodiments of the present invention. FIG. 3 further illustrates the tri-band antenna 200 of FIG. 2 including first, second, and third radiator lines thereof that respectively resonant in three different frequency ranges according to some embodiments of the present invention.

Referring to FIGS. 2 and 3, the antenna 200 includes three radiator lines 202, 204, and 206 (each illustrated with exemplary current flows) that respectively resonant in three different frequency ranges. The radiator lines 202, 204, and 206 can be integrally formed on a flexible film. For example, the three radiator lines 202, 204, and 206 may be deposited or otherwise formed from a conductive material (e.g. 9-10 μm width lines) in a pattern that extends across a flexible film. For example, the three radiator lines 202, 204, and 206 may be formed from a copper sheet or, alternatively, may be formed from a copper layer that is deposited on a flexible dielectric ribbon that is fixedly connected to and supported by various interior surfaces of the housing 110, such as the various configurations described herein. It will be understood that antennas according to embodiments of the invention may be formed from other conductive materials and are not limited to copper.

The first radiator line 202 can extend from a feed node 210, which is adjacent to the first side surface 116, through a central region of the housing 110 to a branch location 300 that is located adjacent to the second side surface 118. Radiator line 202 then loops back to a ground node 220 that is adjacent to the first side surface 116. The first radiator line 202 is configured to resonate in a first frequency range responsive to first electromagnetic radiation that is coupled to the feed node 210 and the ground node 220 by communications circuitry, such as that described further below.

The second radiator line 204 is connected to the feed node 210 and extends away from the ground node 220 toward the back surface 114 of the housing 110. The second radiator line 204 is configured to resonate in a second frequency range responsive to second electromagnetic radiation that is coupled to the feed node 210 and the ground node 220.

The third radiator line 206 is connected to the branch node 300 and extends away from an adjacent portion of the first radiator line 202 toward the back surface 114. The third radiator line 206 is configured to resonate in a third frequency range responsive to third electromagnetic radiation coupled to the feed node 210 and the ground node 220. The third radiator line 206 may be connected to the branch node 300 within a middle region along a length of the first radiator line 202 between the feed node 210 and the ground node 220. In some embodiments, the third radiator line 206 is connected to the branch node at a location that is midway along a length of the first radiator line 202 between the feed node 210 and the ground node 220. The second and third radiator lines may each extend in opposite directions toward one another across at least a quarter of the back interior housing surface 114.

Accordingly, the antenna 200 may extend across a bottom portion 120 of the housing 110 along a single plane, although one or more of the first, second, and third radiator lines 202-206 may extend in nonplanar directions relative to one another. The first, second, and third radiator lines 202-206 can thereby be supported by various interior surfaces of the housing 110 and can have substantially different lengths and correspondingly substantially different resonant frequency ranges.

It will be understood by those skilled in the art in view of the present description that the antenna 200 may be used for transmitting and/or receiving RF electromagnetic radiation to/from the multi-band wireless terminal 100 to support communications in multiple frequency bands. In particular, during transmission, the first, second, and/or third radiator lines 202-206 resonate in response to signals received from a transmitter portion of a transceiver and radiates corresponding RF electromagnetic radiation into free-space in their corresponding frequency bands. During reception, the first, second, and/or third radiator lines 202-206 resonate responsive to incident RF electromagnetic radiation received via free-space and provide a corresponding signal (in their corresponding frequency band) to the transceiver circuitry.

The first, second, and third radiator lines 202-206 can be connected to and fixedly supported by interior surfaces of the housing 110. For example, as shown in FIGS. 2-3, the first radiator line 202 can be connected to and fixedly supported by the opposite side surfaces 116 and 118, extend through a central region of the housing 110 and loop back along the front interior housing surface 112. The second radiator line 204 can extend along and be fixedly supported by the first side interior housing surface 116 and by the back side interior housing surface 114. The third radiator line can extend along and be fixedly supported by the second side interior housing surface 118 and by the back interior housing surface 114.

The first, second, and third frequency ranges of the respective first, second, and third radiator lines 202-206 can be substantially different from one another and may be exclusive of one another (i.e., nonoverlapping frequency ranges). For example, in one non-limiting embodiment, the length of the first radiator line 202 between the feed node 210 and the ground node 220 may be at least twice as long as a length of the second radiator line 204 and a length of the third radiator line 206. The second and third radiator lines 204-206 may have the same length, however because of where the second and third radiator lines 204-206 are connected to the first radiator line 202, the second and third radiator lines 204-206 are tuned to have substantially different resonant frequencies from one another. The lengths of the first, second, and third radiator lines 202-206 are defined to provide desired respective resonant frequencies.

The first frequency range resonated by the first radiator line 202 may be a higher frequency range than the second and third frequency ranges of the second and third radiator lines 204-206. The second frequency range resonated by the second radiator line 204 may be a higher frequency range than the third frequency range of the third radiator line 206. For example, the first radiator line 202 may be configured to resonate in a frequency range between 2000 and 2700 MHz, the second radiator line 204 may be configured to resonate in a frequency range between 1700 and 2000 MHz, and the third radiator line 206 may be configured to resonate in a frequency range between 800 and 950 MHz. In one particular embodiment, the first radiator line 202 may primarily resonate at 2100 MHz, the second radiator line 204 may primarily resonate at 1800 MHz, and the third radiator line 206 may primarily resonate at 850 MHz.

Although the antenna 200 has been described in the context of the first radiator line 200 extending along the front interior housing surface 112 and the second and third radiator lines 204-206 extending along the back interior housing surface 114, the invention is not limited thereto. For example, the antenna 200 may be flipped-over so that the first radiator line 200 extends along the back interior housing surface 114 and the second and third radiator lines 204-206 extend along the front interior housing surface 112.

Figure 4:
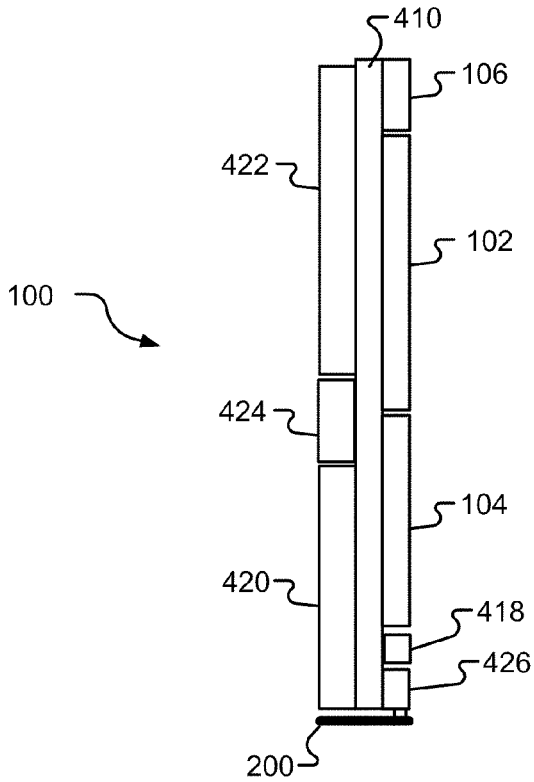
FIG. 4 is a block diagram that illustrates a side view of exemplary components of the wireless communications terminal of FIG. 1 according to some embodiments of the invention.
Figure 5:
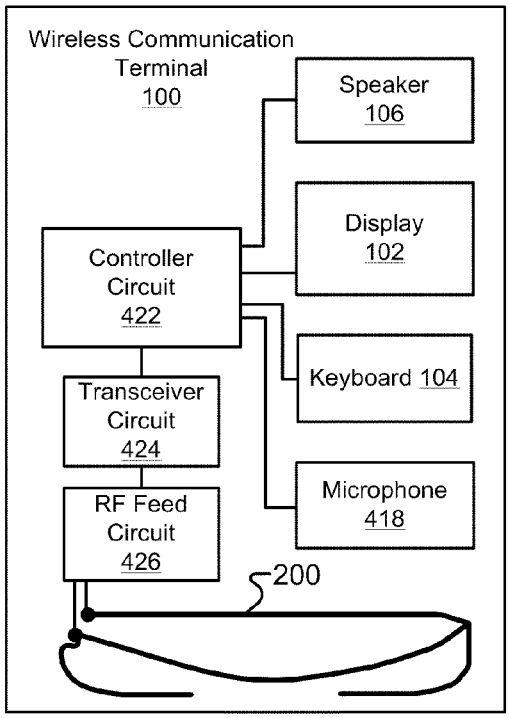
FIG. 5 is a functional block diagram of the exemplary components of the wireless communications terminal of FIG. 1 according to some embodiments of the invention.

FIG. 4 is a block diagram that illustrates a side view of exemplary components of the terminal 100 of FIG. 1 according to some embodiments of the invention. FIG. 5 is a functional block diagram of the exemplary components of the terminal 100 of FIG. 1 according to some embodiments of the invention.

Referring to FIGS. 4 and 5, the terminal 100 can include the tri-band antenna 200, a printed circuit board 410 with an associated ground plane, the speaker 106, the display 102, the user input interface 104 (e.g., keypad/keyboard), a microphone 418, a battery 420, a controller circuit 422, a transceiver circuit 424, and a RE feed circuit 426. The printed circuit board 410 electrically connects and fixedly supports the components 412-426. As show in FIG. 4, the first, second, and third radiator lines 202-206 of the antenna 200 are spaced apart from an edge of the printed circuit board 410 to avoid interference from the ground plane. The first, second, and third radiator lines 202-206 of the antenna 200 may be positioned below the printed circuit board 410 in the bottom portion 120 or in the top portion 124 of the housing 110 so as to not overlap the ground plane of the printed circuit board 410. As explained above, it may be advantageous, but not necessary, to position the antenna 200 within the bottom portion 120 of the housing 110 to provide increased isolation from the speaker 412 which may otherwise interfere with the resonant frequency of one or more of the radiator lines 202-206.

The controller circuit 422 may include a general purpose processor and/or digital signal processor which can execute instructions from a computer readable memory that carry out at least some functionality to enable wireless communications through the transceiver circuit 424, RE feed circuit 426, and antenna 200 to one or more other wireless communication terminals and/or base stations according to one or more RF communication protocols. The controller circuit 422 may functionally operate the speaker 106, the display 102, the user input interface 104, and the microphone 418. The transceiver circuit 424 may be configured to encode/decode and transmit and receive RF communications according to one or more cellular protocols, which may include, but are not limited to, Global Standard for Mobile (GSM) communication, General Packet Radio Service (GPRS), enhanced data rates for GSM evolution (EDGE), code division multiple access (CDMA), wideband-CDMA, CDMA2000, and/or Universal Mobile Telecommunications System (UMTS), WiMAX, and/or Long Term Evolution (LTE).

The RF feed circuit 426 is configured to amplify and supply electromagnetic radiation across the feed node 210 and the ground node 220 that is controlled to be within a selected one of at least three frequency ranges that resonate different ones of the three radiator lines 202-206. The RF feed circuit 426 may be further configured to selectively amplify and supply a signal that is received by any of the three radiator lines 202-206 from another communication terminal/base station to the transceiver 424. To facilitate effective performance during transmission and reception, the output/input impedance of the RF feed circuit 426 can be "matched" to an impedance of the antenna 200 between the feed node 210 and ground node 220 to maximize power transfer between the RF feed circuit 426 and the antenna 200. It will be understood that, as used herein, the term "matched" includes configurations where the impedances are substantially electrically tuned to compensate for undesired antenna impedance components to provide a particular impedance value.

FIG. 6 is a graph that illustrates exemplary LogMag that may be provided by the tri-band antenna 200 of FIGS. 2-3 across three frequency ranges according to some embodiments of the invention. Referring to FIG. 6, the exemplary antenna LogMag is illustrated along the y-axis and the corresponding resonant frequencies are illustrated along the x-axis. It is observed that the antenna provides good performance at 824 MHz, 960 MHz, 1710 MHz, and 2170 MHz, which are particularly important RF frequencies for certain cellular communication protocols.

Although the antenna 200 has been described in the context of the third radiator line 206 being connected to the first radiator line 202 at a branch node 300 that is located within a middle region along a length of the first radiator line 202 between the feed node 210 and the ground node 220, the invention is not limited thereto. The resonant frequency of the first radiator line 202 and/or the third radiator line 206 may be controlled by varying the location of a branch node 300 along the length of the first radiator line 202.

For example, FIG. 7 illustrates a modified embodiment of the tri-band antenna that is shown in FIGS. 2-3 according to some embodiments of the present invention. Referring to FIG. 7, a tri-band antenna 700 includes a first radiator line 702, a second radiator line 704, and a third radiator line 706. The first, second, and third radiator lines 702-706 are configured to resonate in three respective frequency ranges responsive to different electromagnetic radiation being supplied across a feed node 710 and a ground node 720 by communication circuitry, such as the communication circuitry shown in FIGS. 4 and 5. In contrast to the antenna 200 of FIGS. 2 and 3, the third radiator line 706 of FIG. 7 is connected to the first radiator line 702 at a branch node 712 that is spaced apart from a middle of the length of the first radiator line 702 between the feed node 710 and the ground node 720 by a distance that provides a desired resonant frequency for the first radiator line 702 and/or the third radiator line 706. The lengths of the first, second, and third radiator lines 702-706 are defined to provide desired resonant frequencies.

FIG. 8 illustrates another cross-sectional view along plane 2-2 through the terminal 100 of FIG. 1 that shows another exemplary tri-band antenna 800 that extends adjacent to and/or attached to portions of the inner peripheral surfaces of the terminal's housing 110 according to some embodiments of the present invention. Referring to FIG. 8, the tri-band antenna 800 includes a first radiator line 802, a second radiator line 804, and a third radiator line 806. The first, second, and third radiator lines 802-806 are configured to resonate in three respective frequency ranges responsive to different electromagnetic radiation being supplied across a feed node 810 and a ground node 820 by communication circuitry, such as the communication circuitry shown in FIGS. 4 and 5. In contrast to the antenna 200 of FIGS. 2 and 3, the first radiator line 802 has been rotated toward the back interior housing surface 114 so that the third radiator line 806 can extend toward the front interior housing surface 112. The lengths of the first, second, and third radiator lines 802-806 are defined to provide desired resonant frequencies. This configuration of the antenna 800 may reduce the inductive coupling between the second radiator line 804 and the third radiator line 806 and/or may provide different coupling between the second radiator line 804 and the third radiator line 806 and a user's hand/face, which may provide different desirable operational characteristics than the antenna 200 shown in FIGS. 2-3.

Figure 9:
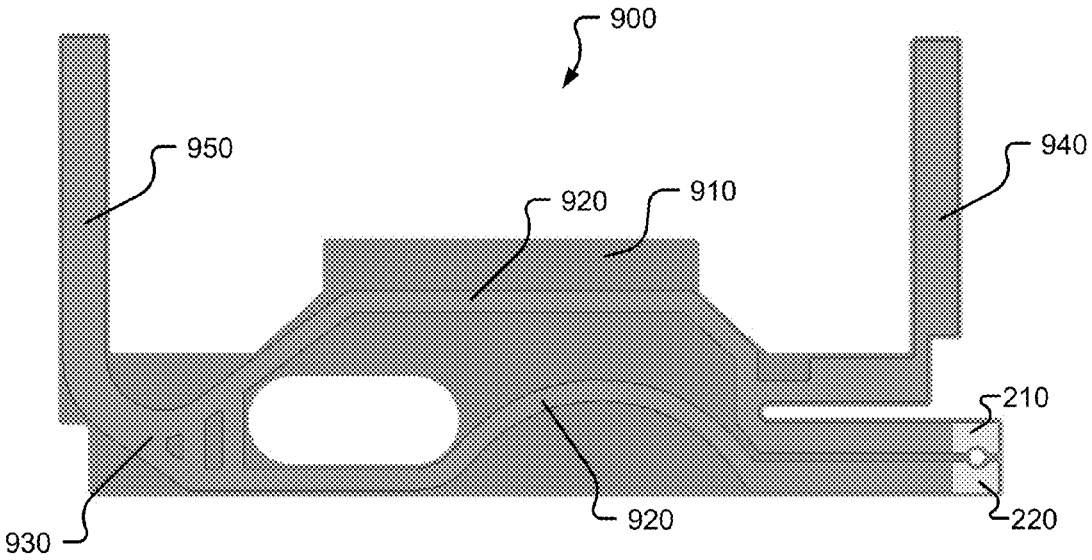
FIG. 9 illustrates a plan view of a tri-band antenna that is integrally formed as a single conductive layer on a flexible film surface according to some embodiments of the present invention.

FIG. 9 illustrates a plan view of another tri-band antenna 900 that is integrally formed as a single conductive layer on a flexible film surface 910 according to some embodiments of the present invention. A first radiator line 920 extends from a feed node 210 through a branch node 930 and loops back to a ground node 220 to form a loop that extends across a major portion of the film surface 910. A second radiator line 940 extends from the feed node 210 away from an adjacent portion of the first radiator line 920. A third radiator line 940 is connected to the branch node 930 and extends away from an adjacent portion of the first radiator line 920.

Figure 10:
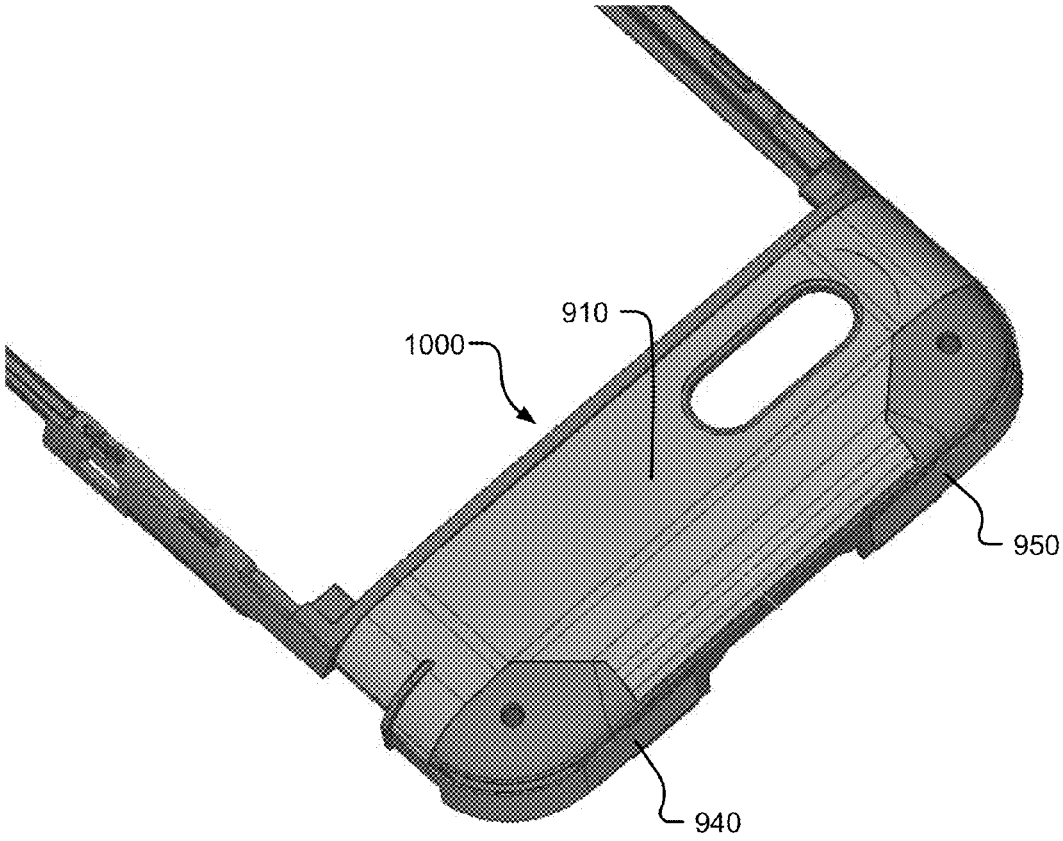
FIG. 10 illustrates the tri-band antenna of FIG. 9 that is wrapped around a lower front/back surface and a side surface of a partially illustrated terminal housing according to some embodiments of the present invention.

FIG. 10 illustrates the tri-band antenna 900 of FIG. 9 that is wrapped around a lower front/back surface and a side surface of a partially illustrated terminal housing 1000 according to some embodiments of the present invention. The first radiator line 920 extends on the flexible film surface 910 across and is fixedly attached to the top surface or the bottom surface of the housing 1000. The second and third radiator lines 940 and 950 extend on the flexible film surface 910 along and are fixedly attached to a side surface (e.g., a top side surface or bottom side surface) of the housing 1000. In some other embodiments, the second and third radiator lines 940 and 950 extend on the flexible film surface 910 along and are fixedly attached to opposite side surfaces (e.g., right and left side surfaces) of the housing 1000

Although various embodiments of multi-band antennas have been described in the context of the communication terminal 100, which has been illustrated as a non-flip type cellular phone, the invention is not limited thereto. Various embodiments of the multi-band antennas may instead be utilized in foldable "clamshell" type wireless communication terminals and in other types of wireless communication terminals that are configured to transmit and receive in a plurality of frequency bands.

Many alterations and modifications may be made by those having ordinary skill in the art, given the benefit of present disclosure, without departing from the spirit and scope of the invention. For example, antennas according to embodiments of the invention may have various shapes, configurations, and/or sizes and are not limited to those illustrated. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A wireless communications terminal comprising:

a housing having an interior surface that is configured to enclose at least a controller circuit, a transceiver circuit, and a RF feed circuit and is configured to at least partially enclose a display device and a user input interface, wherein the housing extends between opposing top and bottom surfaces, between opposing first and second side surfaces, and between opposing front and back surfaces;

a first radiator line that is connected on distal ends to a feed node and to a ground node and extends in a loop across at least a majority of a width of the housing between the first and second side surfaces, wherein the first radiator line is configured to resonate in a first frequency range responsive to first electromagnetic radiation coupled to the feed and ground nodes;

a second radiator line that is connected to the feed node and extends away from an adjacent portion of the first radiator line, wherein the second radiator line is configured to resonate in a second frequency range responsive to second electromagnetic radiation coupled to the feed and ground nodes; and a third radiator line that is connected to the first radiator line at a branch node that is spaced apart from the feed node and the ground node, wherein the third radiator line extends away from an adjacent portion of the first radiator line and is configured to resonate in a third frequency range responsive to third electromagnetic radiation coupled to the feed and ground nodes, wherein the first, second, and third frequency ranges are different from one another, wherein:

the first, second, and third radiator lines extend along a single flexible film surface;

the first radiator line extends on the flexible film surface across the terminal and is fixedly attached to the top surface or the bottom surface;

the second and third radiator lines extend on the flexible film surface along and are fixedly attached to at least one side surface of the housing; and the second and third radiator lines extend on the flexible film surface along and are fixedly attached to opposite side surfaces of the housing.

2. The wireless communications terminal of claim 1, wherein:

the first radiator line extends from the feed node, which is adjacent to the first side surface, through a central region of the housing and the branch node, which is adjacent to the second side surface, and loops back to the ground node, which is adjacent to the first side surface.

3. The wireless communications terminal of claim 1, wherein:

the first, second, and third radiator lines are integrally formed as a single layer on a flexible film surface.

4. The wireless communications terminal of claim 1, further comprising:

a printed circuit board that electrically connects and fixedly supports the controller circuit, the transceiver circuit, and the RF feed circuit, the printed circuit board having opposing major surfaces, wherein the first, second, and third radiator lines do not overlap either of the opposing major surfaces of the printed circuit board.

5. The wireless communications terminal of claim 4, wherein:

the first, second, and third radiator lines are located in a bottom portion of the housing relative to how the housing is held by a user during voice communications through the enclosed controller, transceiver, and RF feed circuits, and the first, second, and third radiator lines are spaced apart from an edge of the printed circuit board.

6. The wireless communications terminal of claim 4, wherein:

the first, second, and third radiator lines are located in a top portion of the housing relative to how the housing is held by a user during voice communications through the enclosed controller, transceiver, and RF feed circuits, and the first, second, and third radiator lines are spaced apart from an edge of the printed circuit board.

7. The wireless communications terminal of claim 1, wherein:

the third radiator line is connected to the branch node midway along a length of the first radiator line between the feed node and the ground node.

8. The wireless communications terminal of claim 1, wherein:

the first frequency range resonated by the first radiator line is a higher frequency range than the second and third frequency ranges; and the second frequency range resonated by the second radiator line is a higher frequency range than the third frequency range.

9. The wireless communications terminal of claim 8, wherein:

a length of the first radiator line between the feed node and the ground node is at least twice as long as a length of the second radiator line and a length of the third radiator line.

10. The wireless communications terminal of claim 8, wherein:

the first frequency range resonated by the first radiator line is in a frequency range between 2000 and 2700 MHz;

the second frequency range resonated by the second radiator line is in a frequency range between 800 and 950 MHz; and the third frequency range resonated by the third radiator line is in a frequency range between 1800 and 2000 MHz.

11. The wireless communications terminal of claim 10, wherein:

the first frequency range resonated by the first radiator line includes 2100 MHz;

the second frequency range resonated by the second radiator line includes 850 MHz; and the third frequency range resonated by the third radiator line includes 1800 MHz.

12. A wireless communications terminal comprising:

a housing having an interior surface that is configured to enclose at least a controller circuit, a transceiver circuit, and a RF feed circuit and is configured to at least partially enclose a display device and a user input interface, wherein the housing extends between opposing top and bottom surfaces, between opposing first and second side surfaces, and between opposing front and back surfaces;

a first radiator line that is connected on distal ends to a feed node and to a ground node and extends in a loop across at least a majority of a width of the housing between the first and second side surfaces, wherein the first radiator line is configured to resonate in a first frequency range responsive to first electromagnetic radiation coupled to the feed and ground nodes;

a second radiator line that is connected to the feed node and extends away from an adjacent portion of the first radiator line, wherein the second radiator line is configured to resonate in a second frequency range responsive to second electromagnetic radiation coupled to the feed and ground nodes; and a third radiator line that is connected to the first radiator line at a branch node that is spaced apart from the feed node and the ground node, wherein the third radiator line extends away from an adjacent portion of the first radiator line and is configured to resonate in a third frequency range responsive to third electromagnetic radiation coupled to the feed and ground nodes, wherein the first, second, and third frequency ranges are different from one another, wherein:

the first radiator line extends to the ground node adjacent to one of the front and back housing surfaces, the second radiator line extends along the first side housing surface and along the other one of the front and back housing surfaces that is opposite the ground node, and the third radiator line extends along the second side housing surface and along the same one of the front and back housing surfaces as the second radiator line;

a portion of the first radiator line is fixedly connected to and supported by the one of the front and back interior housing surfaces that is adjacent to the ground node;

a majority of the second radiator line is fixedly connected to and supported by both the first side interior housing surface and the other one of the front and back interior housing surfaces that is opposite to the one of the front and back interior housing surfaces adjacent to the ground node; and the third radiator line is fixedly connected to and supported by both the second side interior housing surface and the same one of the front and back interior housing surfaces as the second radiator line.

13. The wireless communications terminal of claim 12, wherein:

the second and third radiator lines extend in opposite directions toward each other along at least a quarter of the one of the front and back interior housing surfaces that is opposite to the one of the front and back interior housing surfaces adjacent to the ground node.

14. A wireless communications terminal comprising:

a housing having an interior surface that is configured to enclose at least a controller circuit, a transceiver circuit, and a RF feed circuit and is configured to at least partially enclose a display device and a user input interface, wherein the housing extends between opposing top and bottom surfaces, between opposing first and second side surfaces, and between opposing front and back surfaces;

a first radiator line that is connected on distal ends to a feed node and to a ground node and extends in a loop across at least a majority of a width of the housing between the first and second side surfaces, wherein the first radiator line is configured to resonate in a first frequency range responsive to first electromagnetic radiation coupled to the feed and ground nodes;

a second radiator line that is connected to the feed node and extends away from an adjacent portion of the first radiator line, wherein the second radiator line is configured to resonate in a second frequency range responsive to second electromagnetic radiation coupled to the feed and ground nodes; and a third radiator line that is connected to the first radiator line at a branch node that is spaced apart from the feed node and the ground node, wherein the third radiator line extends away from an adjacent portion of the first radiator line and is configured to resonate in a third frequency range responsive to third electromagnetic radiation coupled to the feed and ground nodes, wherein the first, second, and third frequency ranges are different from one another, wherein:

the first radiator line extends to the ground node adjacent to one of the front and back housing surfaces, the second radiator line extends along the first side housing surface and along the other one of the front and back housing surfaces that is opposite to the one of the front and back interior housing surface adjacent to the ground node, and the third radiator line extends along the second side housing surface and along the same one of the front and back surfaces as the ground node;

a portion of the first radiator line is fixedly connected to and supported by the one of the front and back interior housing surfaces that is adjacent to the ground node;

a majority of the second radiator line is fixedly connected to and supported by both the first side interior housing surface and the other one of the front and back interior housing surfaces that is opposite to the one of the front and back interior housing surfaces adjacent to the ground node; and the third radiator line is fixedly connected to and supported by both the second side interior housing surface and the same one of the front and back interior housing surfaces that is adjacent to the ground node.

15. The wireless communications terminal of claim 14, wherein:

the second and third radiator lines extend in opposite directions toward each other along at least a quarter of respective ones of the front and back interior housing surfaces.

16. A wireless communications terminal comprising:

a housing having an interior surface that is configured to enclose at least a controller circuit, a transceiver circuit, and a RF feed circuit and is configured to at least partially enclose a display device and a user input interface, wherein the housing extends between opposing top and bottom surfaces, between opposing first and second side surfaces, and between opposing front and back surfaces;

a first radiator line that extends from a feed node that is adjacent to the first side surface through a central region of the housing and a branch node adjacent to the second side surface and loops back to a ground node that is adjacent to the first side surface, wherein the first radiator line is configured to resonate in a first frequency range responsive to first electromagnetic radiation coupled to the feed and ground nodes, and wherein a portion of the first radiator line is fixedly connected to and supported by the one of the front and back interior housing surfaces that is adjacent to the ground node;

a second radiator line that is integrally connected to the first radiator line at the feed node and extends away from the ground node toward another one of the front and back interior housing surfaces that is opposite the one of the front and back interior housing surfaces, wherein the second radiator line is configured to resonate in a second frequency range responsive to second electromagnetic radiation coupled to the feed and ground nodes, wherein a majority of the second radiator line is fixedly connected to and supported by both the first side interior housing surface and the other one of the front and back interior housing surfaces that is opposite the ground node;

a third radiator line that is integrally connected to the branch node and extends away from an adjacent portion of the first radiator line, wherein the third radiator line is configured to resonate in a third frequency range responsive to third electromagnetic radiation coupled to the feed and ground nodes, wherein the first, second, and third frequency ranges are different from one another, and wherein the third radiator line is fixedly connected to and supported by both the second side interior housing surface and the same one of the front and back interior housing surfaces as the second radiator line;

a printed circuit board that electrically connects and fixedly supports the controller, transceiver, and RF feed circuits, the printed circuit board having opposing major surfaces, wherein the first, second, and third radiator lines are located in a bottom portion of the housing relative to how the housing is held by a user during voice communications through the enclosed controller, transceiver, and RF feed circuits, and the first, second, and third radiator lines are spaced apart from an edge of the printed circuit board.

* * * * *

UNITED STATES PATENT AND TRADEMARK OFFICE

CERTIFICATE OF CORRECTION

PATENT NO. : 8,378,899 B2
APPLICATION NO. : 12/613843
DATED : February 19, 2013
INVENTOR(S) : Galeev It is certified that error appears in the above-identified patent and that said Letters Patent is hereby corrected as shown below:

On Title Page:
Item 56, Page 1, References Cited, Other Publications, right column, Please add the reference below:

-- Notification of Transmittal of the International Preliminary Report on Patentability; International Preliminary Report on Patentability corresponding to International Application No. PCT/IB2009/051070; Date of Mailing: December 7, 2010; 8 pages. --

Signed and Sealed this
Twenty-seventh Day of May, 2014

Michelle K. Lee

Michelle K. Lee
*Deputy Director of the United States Patent and Trademark Office*